United States Patent [19]

Woods

[11] Patent Number: 4,593,894

[45] Date of Patent: Jun. 10, 1986

[54] AIR ASSIST DELIVERY SYSTEM

[76] Inventor: Kenneth D. Woods, 3158 Aurora Vista Dr., Spring Valley, Calif. 92077

[21] Appl. No.: 264,286

[22] Filed: May 18, 1981

Related U.S. Application Data

[63] Continuation of Ser. No. 032,556, Apr. 23, 1979, abandoned.

[51] Int. Cl.[4] ..... B65H 29/38

[52] U.S. Cl. ..... 271/177; 271/188; 271/195; 414/69

[58] Field of Search ..... 271/177, 195, 188, 108, 271/180, 209; 414/69

[56] References Cited

U.S. PATENT DOCUMENTS

| | | | |
|---|---|---|---|
| 2,151,136 | 3/1939 | Moffitt | 271/175 |
| 2,299,259 | 10/1942 | Sites | 271/177 |
| 2,769,495 | 11/1956 | Pomper | 271/195 |
| 2,796,259 | 6/1957 | Fawcett | 271/188 |
| 2,805,858 | 9/1957 | Hayes | 271/177 |
| 4,239,205 | 12/1980 | Bourque | 271/175 |

*Primary Examiner*—Joseph E. Valenza

*Attorney, Agent, or Firm*—Baker, Maxham & Jester

[57] ABSTRACT

A system for delivery and stacking sheets of paper into a receiving tray or chute from a processing machine, such as a printing machine and the like, includes supporting flanges at the open end of the chute for supporting the side edges of the paper and an air jet system vertically above the paper for bending the paper about its axis for longitudinal support of the paper to prevent roll and tumble of the sheet into the chute.

11 Claims, 4 Drawing Figures

AIR ASSIST DELIVERY SYSTEM

This is a continuation of application Ser. No. 032,556, filed Apr. 23, 1979, now abandoned.

BACKGROUND OF THE INVENTION

The present invention relates to paper processing and particularly to the delivery and stacking of sheets of paper into a chute.

The rate of production of printing machines such as lithographic presses and the like is limited by the speed with which the paper ejected from the machine can be received and stacked in a chute or tray. The typical delivery system from an offset printing machine includes a chute open at one end and inclined at an angle such that sheets exiting from the machine are also directed downward at substantially the same angle to fall into the bottom of the chute or tray. The speed with which the chute can accept sheets of paper is then limited substantially by the rate at which the sheets can fall by gravity to the bottom of the chute. The sheets of paper enter the tray at a height that would be approximately the maximum limit of a stack in the tray when full. The sheet then falls to the bottom of the tray with the next sheet entering the chut at the same level and falling on top of the previous sheet and so on until the chute is full. Thus, the feeding into the chute is substantially limited to the gravity feed rate as the sheet falls downward from the machine. Of course, the sheet moves outward away from the machine under the inertia resulting from the speed with which it exited from the machine.

Other disadvantages of the systems are that the sheets tend to fall and slide across the printed surface of the previous sheet. When the sheets are freshly printed, this can smear ink, especially on slick surfaced paper.

Other disadvantages of the prior art are that thin sheets of paper, such as onion skin and the like, tend to roll and tumble into the chute. This results in an immediate jam-up of paper in the chute, with the result that the machine must be shut down until the chute is cleared. Sheets which have been laminated by a coating of moisture have a tendency to bow or curl and roll into the chute.

It is frequently necessary to build up the bottom of the chute by a block or false bottom so that the sheets land and come to rest before they have a chance to curl and tumble, thus reducing the capacity of the chute so that it must be cleared more often.

Another disadvantage is that paper will frequently fail to move completely to the end of the tray, with the result that the sheets will not be stacked evenly in the tray. Thus, the stack must then be removed and jolted or shook to jolt the edges of the sheets together for packaging.

Accordingly, it is desirable that some apparatus be available which enhances the speed and quality of the stacking of sheets of paper from a machine.

SUMMARY AND OBJECTS OF THE INVENTION

It is therefore a primary object of the present invention to overcome the above problems of the prior art.

Another object of the present invention is to provide an improved sheet delivery system for improving the stacking of sheets of paper in a printing machine chute.

A further object of the present invention is to provide an improved delivery system which prevents the rolling, tumbling and jamming up of paper in a chute.

In accordance with the primary aspects of the present invention, a delivery system for improving the delivery and stacking of sheets of paper into a chute or tray includes support means for supporting the edges of paper and force means for forcing the center of the paper downward to bow the paper about its axis for support and rapid delivery of the paper into the chute.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
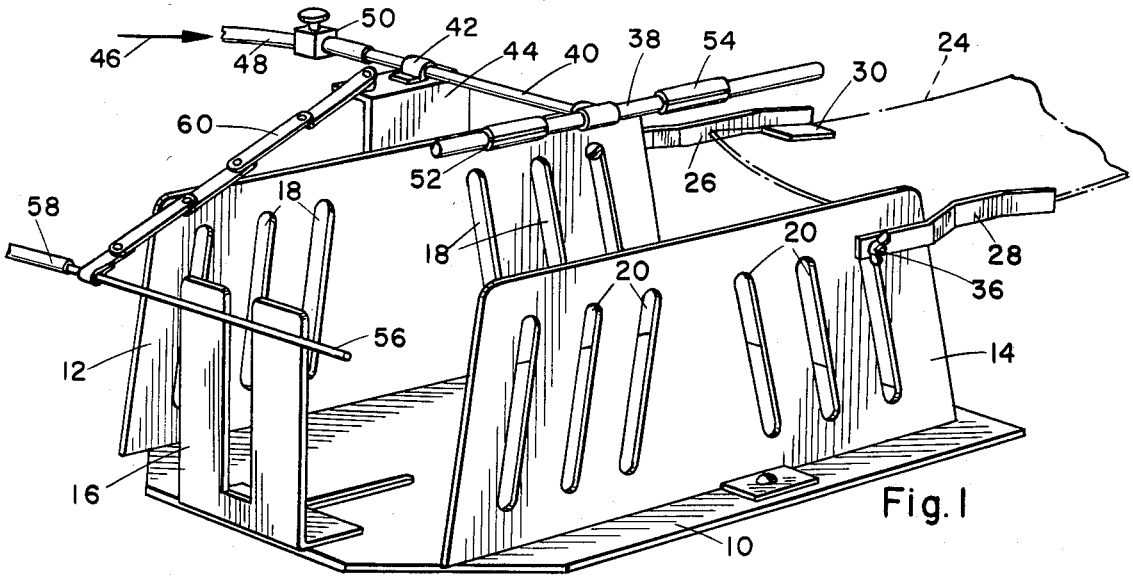
FIG. 1 is a perspective view of a typical chute with paper deflectors and blowers installed.

Turning now to the drawings, there is illustrated an improved delivery system in accordance with the present invention wherein a paper chute or tray is equipped with a delivery assist system in accordance with the invention.

Most printing and duplicating machines which print on single sheets of paper in succession, or at least deliver single sheets of paper in succession from the machine, typically deliver such sheets in a delivery chute or tray, such as illustrated in FIGS. 1 through 4. The tray includes a bottom or plate 10 having a pair of vertically extending side walls 12 and 14 secured thereto and extending upward for defining the sides of the chute. The side walls 12 and 14 are typically adjustable toward and away from one another for adjusting the size of paper that can be received within the chute. The chute in addition includes an end wall or stop member 16 for stopping the paper. The tray or chute is thus constructed to have an open front end into which the paper is received as shown, for example, in FIGS. 1 and 3. The end stop or gate 16 is typically adjustable along the axis of the chute for adjusting the length of paper that can be accepted within the machine.

The side walls 12 and 14 are substantially identical and each include a plurality of slots 18 to 20, which, particularly in connection with the present invention, become vent slots.

Figure 3:
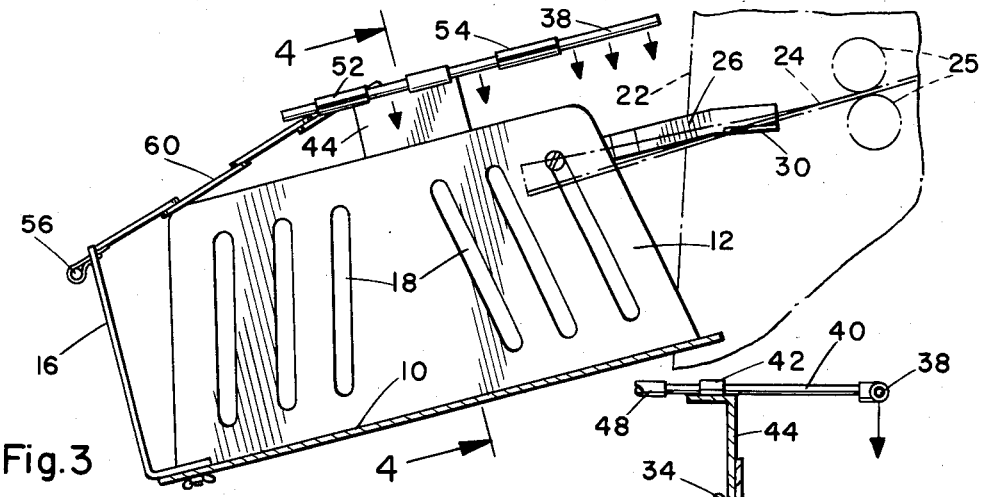
FIG. 3 is a sectional view taken on line 3—3 of FIG. 2.
Figure 4:
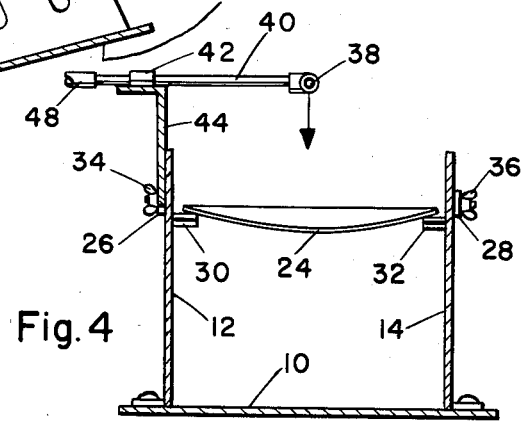
FIG. 4 is a sectional view taken on line 4—4 of FIG. 3.

As best seen in FIG. 3, the tray or chute is typically mounted at the exit of a machine, a portion of which is shown in phantom at 22. Sheets of paper 24 exiting from the machine are fed in succession into the chute. These sheets, as will be appreciated from FIG. 3, exit from the machine at substantially the same angle as the base or bottom of the chute and fall substantially by gravity downward to the end of the chute against the fence or stop 16 and on the bottom of the chute. As will be appreciated when viewing FIG. 3, for example, a sheet exiting from the machine must fall away, out of the way and interference of a succeeding sheet to prevent jamming or jam-up and blocking of the sheets in the tray. The present invention was conceived to overcome the above problems by providing means for supporting the sheet along its edges at a greater distance into the tray or chute and then provide means for applying pressure and force vertically downward on the sheet for folding the sheet or bending the sheet about its longitudinal axis and to simultaneously force the sheet downward into the bottom of the chute. This invention takes advantage of the fact that paper typically has a grain that runs along the longest dimension of the paper. Thus, when the paper is thus bent around its longitudinal axis or along its longitudinal axis, around an axis parallel thereto, the paper will tend to have support along its length. Thus, bending the sheet about its longitudinal axis prevents the sheet from bending transverse to its axis and rolling or tumbling into the chute.

In carrying out the purpose of the present invention, apparatus comprises edge support means in the form of a pair of lift guides 26 and 28, each comprising an elongated arm having an inwardly extending deflecting cam or flange 30 and 32 for supporting the side edges of the sheets. These lift guides are adjustably connected at one end by means of nuts and bolts 34, 36 for ease of adjustment vertically. The wing nut and bolt assembly fits within the forward slots 18 and 20 of the respective side walls 12 and 14. In the typical construction, the heads of the screws are counter-sunk within the slots to avoid any interference with paper or sheets passing into the chute. The guide members extend outward forward of, and to each side of the open end of the chute for engaging just beneath the two sides of a sheet 24 as it exits from between the two pullout rollers 25 of the machine. This provides lateral support along the side edges for the sheet until it clears the pullout rollers.

A downward pressure is then applied to the sheet by a plurality of jets directed downward from an air tube 38 having a leg portion 40 secured such as by a clamp 42 to a bracket or the like or other suitable support structure 44, at the side of the chute. A suitable source of air (not shown) designated by the numeral 46, is connected by a conduit or the like 48 to the air tube 38. A suitable source of air is the exhaust from the vacuum system of the machine. Such machines are equipped with a vacuum system for picking up the sheets of paper for feeding into the machine. A portion of the exhaust is used to separate the sheets of paper. Suitable valve means 50 is provided for controlling the volume of air fed to the tube 38. The tube 38 extends along parallel to the axis of the tray directly above the position where the paper enters into the tray. A plurality of jets for directing air downward against the upper surface of the sheet of paper substantially at or along the center thereof are formed in the underside of the tube 38. Control of the number of ports open is accomplished, for example, by means of a plurality of slit tubes, or sleeves 52, 54 mounted on the air tube 38. These tubes are slit along the length thereof and can be rotated and slid along the tube such that the slits are out of registry with the jets or can be rotated to a position such that the jets are not covered by the slits. Thus, the air from selective jets can be controlled by means of the sleeves or tubes 52, 54. As shown, for example, in FIG. 3, the sleeves 52 and 54 are rotated to a position to close off jets directly beneath the sleeves. Other jets not covered by the sleeves direct jets of air downward as shown by the arrows in FIG. 2. Thus, the position and number of jets acting downward on the surface of the sheet of paper can be controlled for control of the delivery of the paper. Similarly the amount and force of flow of the air to the jets can be controlled by the adjustable valve 50 within the supply line.

With this arrangement, as a sheet of paper is entering the chute, the directional guide brackets support the edge of the sheet directing the sheet upward and substantially parallel to the chute angle so that the sheet does not drop down and drag across the surface of previous printed sheets. As the sheet enters the chute, the downward force of air (as will be seen in FIG. 4) forces the sheet to bend or bow downward about its longitudinal axis, thus preventing the sheet from bending about its transverse axis. In addition, this air blast system forces the sheet downward in the center, thereby intensifying and utilizing the grain in the sheet of paper to full advantage by discouraging the sheet from curling or tumbling as it enters the chute. The sheet then, as it clears the directional guide brackets, is forced downward out of the way of the next sheet by the air blast and forced to rest on the bottom of the chute or on preceeding printed sheets in the chute. Thus, the paper moves quickly downward toward the bottom of the chute once it clears the lift guides. The air blast can be adjusted to speed the movement of the sheet downward toward the bottom of the chute, thus forcing it to rapidly clear the path for the next succeeding sheet. Thus, the sheet is positively forced downward upon leaving the support and directional guides immediately and out of interference position of the next sheet coming into the chute. This increases the productive speed capability of the machine on which the device is attached.

The air blast also helps eliminate static build up as the air blast forces sheets to conform and overcome static resistance as it moves directly onto the surface of the preceeding sheet. With this attachment, it is not necessary to build up the bottom of the chute by placing a false bottom or block in the chute as was previously done to prevent downward curl of thin or moist sheets of paper. Thus, tumble of the paper in the chute is prevented, as well as permitting a greater number of sheets to be fit into the chute. In addition, as will be appreciated from viewing FIG. 4, the sheet moves downward with the center thereof bowed downward, the sides are bowed upward permitting air to escape from beneath that sheet and between it an the preceeding sheet out the slits in the sides of the chute. The sheet is thus forced from the air blast into close nesting contact with the previus sheet, thus again preventing air from being trapped between the sheets and permitting greater numbers of sheets to be stacked in the chute. In addition, the air on the sheet cushions the next succeeding sheet as it comes through the chute.

Another advantage of the system is that the air helps dry the printed surface faster since the air temperature is somewhat warmer than room temperature if the source of air, as contemplated, is that of the exhaust system from the printing machine. The chute will hold more sheets of paper as the air blast source forces printed sheets to lay flat, not permitting the paper to pile up to require more vertical height due to the paper curl or distortions from moisture, absorption and other problems.

Figure 2:
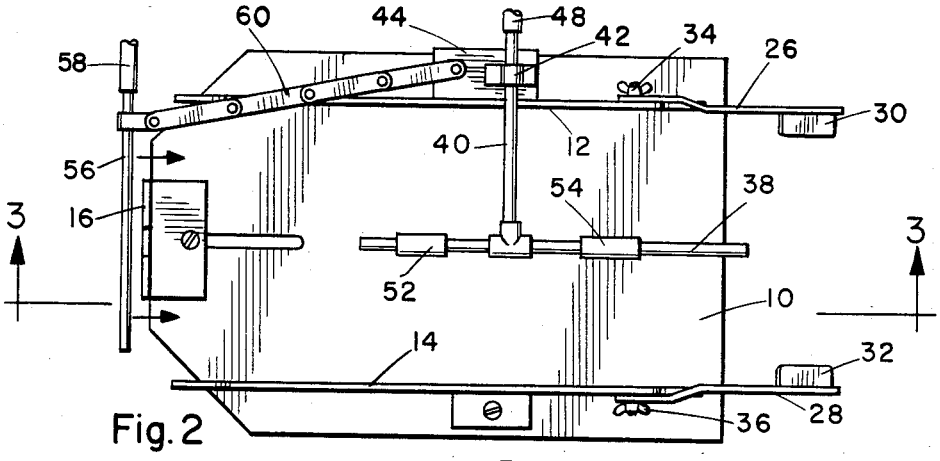
FIG. 2 is a top plan view of the structure of FIG. 1.

An additional attachment or feature which can be utilized in conjunction with the present invention is an auxillary air supply consisting of an air tube 56 connected by a suitable conduit or the like 58 to the air source of supply and attached such as by an extensible bracket 60 to support structure 44. This extensible bracket permits the air tube 56 with a plurality of jets directing air along parallel to the flow of the sheets as illustrated in FIGS. 1 and 2, for example, provides air for assisting and cushioning and controlling the dropping of the sheets and for drying the sheets.

While the present invention has been illustrated and described by means of a specific embodiment, it is to be understood that numerous changes and modifications can be made therein without departing from the spirit and scope of the invention as defined in the appended claims. For example, the air assist or jets can be used in conjunction with other types of delivery systems such as chain delivery systems. In such systems the sheet is pulled from the machine by grippers on chains and simply released to fall by gravity onto a stack. With such systems only the jets disposed substantially directly above the sheet when released is all that is required. The lift guides are not believed essential in these systems.

Having described my invention, I now claim:

1. A sheet delivery stacking system comprising in combination:

a sheet receiving chute disposed for receiving individual flat rectangular sheets moving in succession from a machine;

support means for engaging and supporting the side edges of a sheet during movement of said sheet toward and at least partially into the chute, and air pressure means for applying a continuous force of air to the upper surface of said sheet while supported by said support means during movement into said chute for bending said sheet about its longitudinal axis for providing longitudinal support thereof and for rapidly forcing said sheet into said chute out of the way of succeeding sheets.

2. The sheet delivery system of claim 1, wherein said support means comprises an inwardly directed flange member disposed at each side of the open front of said chute for engaging the underside of the sheets along the edge thereof.

3. The sheet delivery system of claim 1, wherein said pressure means comprises a plurality of jets of air directed at said sheet from above.

4. The sheet delivery system of claim 3, wherein said jet of air is adjustable for adjusting the force on said sheets.

5. The sheet delivery system of claim 2, wherein said pressure means comprises a plurality of jets of air directed against said sheet from above.

6. The sheet delivery system of claim 5, wherein said plurality of jets are formed in a tube extending along the axis of and above said chute.

7. The sheet delivery system of claim 6, including at least one sleeve rotatably and slidably mounted on said tube for selectively covering one or more of said jets.

8. The sheet delivery system of claim 2, wherein said flange members are mounted on arms that extend in front of said chute.

9. The sheet delivery system of claim 8, wherein said arms are adjustable for adjusting the height of said flange members.

10. The sheet delivery system of claim 6, wherein said chute slopes downward at an angle away from the machine from which the sheets are being delivered.

11. The sheet delivery system of claim 3, including a jet of air directed along the axis of said sheets into said chute from one end thereof.

* * * * *